US005327760A

United States Patent [19]

Böhmer et al.

[11] Patent Number: 5,327,760

[45] Date of Patent: Jul. 12, 1994

[54] ROLLER LEVELLER

[75] Inventors: Bruno Böhmer, Erkrath; Erich M ker, Kreuztal; Klemens Bierman, Langenfeld; Markus Willems, Erkrath, all of Fed. Rep. of Germany

[73] Assignee: SMS Schloemann-Siemag Aktiengesellschaft, Dusseldorf, Fed. Rep. of Germany

[21] Appl. No.: 3,717

[22] Filed: Jan. 13, 1993

[30] Foreign Application Priority Data

Dec. 17, 1992 [DE] Fed. Rep. of Germany ..... 4201072

[51] Int. Cl.[5] ..... B21D 3/02

[52] U.S. Cl. ..... 72/164; 72/247

[58] Field of Search ..... 72/164, 165, 160, 247

[56] References Cited

U.S. PATENT DOCUMENTS 3,719,067 3/1973 Skawden ..... 72/164

3,750,448 8/1973 Oxlade ..... 72/247

4,022,046 5/1977 Serizawa ..... 72/164

FOREIGN PATENT DOCUMENTS 1041849 9/1966 United Kingdom ..... 72/164

*Primary Examiner*—Daniel C. Crane

*Attorney, Agent, or Firm*—Anderson Kill Olick & Oshinsky

[57] ABSTRACT

A roller leveller, in particular, for beams with a large web depth, includes a carrier shaft on which lower levelling rollers are mounted in a cantilever fashion and which is arranged in a bearing housing with a possibility of dual axial displacement. The bearing housing rests on lifting elements and is displaceable up and down in vertical guides of a horizontally displaceable carrier slide. The bearing housing is pivotably arranged about an inclination adjustment axis that extends transverse to the carrier shaft axis.

7 Claims, 4 Drawing Sheets

ROLLER LEVELLER

BACKGROUND OF THE INVENTION

The invention relates to a roller leveller, in particular, for a beam having a large web depth, and in which the lower levelling rollers are mounted on a carrier shaft in a cantilever fashion, the carrier shaft is supported in a bearing housing for a dual axial displacement, with the bearing housing resting on vertical motor-driven lifting elements and displaceable in vertical guides of a horizontally displaceable carrier slide up and down.

During a levelling run, in particular of beams with a large web depth and a cross-section having correspondingly high flexural resistance, the levelling process requires, in accordance with the degree of deformation, application to a beam of repeated large levelling forces, the reaction pressure of which stresses the carrier shaft of the levelling rollers, the bearing housing in which the carrier shaft is located, and the support frame. The magnitudes and the directions of the stresses, which are applied to the elements of the roller leveller, depend, respectively, on the size and the profile of the shape deviations of the beam.

Accordingly, the main object of the invention is to so improve the roller leveller that it is capable to withstand the increased stresses, without a substantial increase in size of the carrier shaft of the levelling rollers, its bearing housing as well as the carrier slide, which supports the bearing housing, and the support frame.

SUMMARY OF THE INVENTION

This and other objects of the invention, which will become apparent thereafter, are achieved by providing a roller leveller in which the bearing housing for the levelling roller carrier shaft pivots about an inclination adjustment axis that extends transverse to the axis of the carrier shaft. Thereby, it is possible to preset the inclination position of the carrier shaft relative to its horizontal axial position, in accordance with expected direction and magnitude of the reaction pressure resulting from the levelling deformation. An additional axial adjustment of the carrier shaft position is thereby also possible. The presetting of the inclination position of the carrier shaft, according to the invention, is further effected by pivotal movement of the vertical guides of the bearing housing about the inclination adjustment axis.

The vertical guides of the bearing housing can, according to the invention, be formed of pivot bearings that are displaceable in the bearing housing and receive bearing journals, which are fixedly secured to the carrier slide, extend into the pivot bearings, and define the inclination adjustment axis. The pivot bearings themselves are formed by bearing blocks having bores for receiving the bearing journals. The vertical guides and the inclined guides for the bearing housing can also be formed of parallel guide beads, which are arranged on the sides of the bearing housing and extend transverse to the plane of the bearing axis. The guide beads are supported on slightly convex support surfaces of guides strips arranged on the carrier slide.

The lifting elements can be driven in dependence on each other or independently from each other. In a roller leveller, in which the lifting elements are formed by lifting spindles driven by a common shaft and of which first one is arranged in a region below the levelling roller and a second one is arranged in a region below a carrier shaft bearing located remotely from the levelling roller, the first lifting spindle can, according to the invention, be connected with a common drive by a magnet shaft coupling, so that the inclination adjustment is effected with the second lifting spindle. If needed, an additional axial correction of the carrier shaft can be effected with a supplementary adjusting device provided for this purpose.

The magnitude of adjusting displacements of the lifting elements and the elements for axial displacement of the carrier shaft should be determined not only on the basis of magnitudes and directions of stresses which are caused by the reaction pressure resulting form the levelling deformation, but also on the basis of he bending stresses of the carrier shaft itself and the tensile stresses of the bearing housing, the carrier slide that supports it and the whole machine frame. The displacements magnitudes are determined by a control device which is connected with a microprocessor in which preset position values are stored.

The objects and features of the present invention will become more apparent and the invention itself will be best understood form the following detailed description of the preferred embodiment when read with reference to the accompanying drawings.

DETAILED DESCRIPTION OF THE PREFERRED EMBODIMENT

Figure 1:
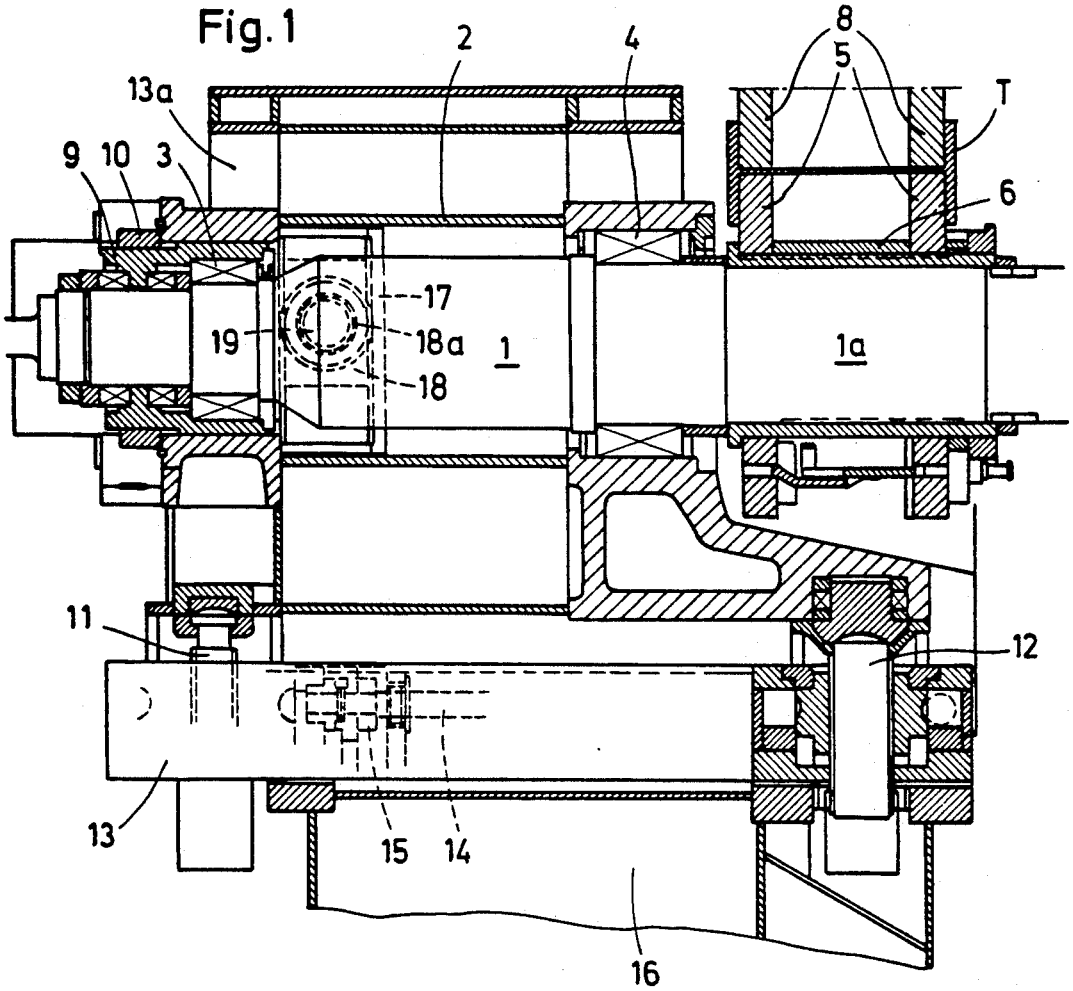
FIG. 1 shows a partial axial cross-sectional view of a roller leveller according to the present invention.

FIG. 1 shows a roller leveller including a carrier shaft 1 located in a bearing housing 2 in bearings 3 and 4. A levelling roller is supported on a journal la, which is located outside of the bearings 3 and 4. The levelling roller consists of two levelling discs 5 and an assembly sleeve 6 with a spacing sleeve and a tensioning nut. The elements of the levelling roller are held together by a hydraulic nut with a bayonet catch (not shown), which is placed on the journal la from outside. The levelling discs that acts on a T-beam, which is to be levelled, from above and that form an upper levelling roller (not shown in detail), which is not vertically adjustable, are designated with a reference numeral 8. They are generally supported in a cantilever fashion directly in a horizontally displaceable housing without hoisting elements. At the end of the carrier shaft 1 remote from the journal 1a, there is provided an adjusting device, which is formed of an insert nut 9 with axial bearings and a spur gear 10 connected to the insert nut. The bearing housing 2 is supported on lifting spindles 11 and 12, which are located in a carrier slide 13 that frames the bearing housing 2 at the sides with supporting walls **13*a* (See also FIG. 2). Both lifting spindles 11 and 12 are driven independently from each other or simultaneously together by a drive shaft 14 shown with dash lines. This drive shaft 14 is connected by an electromagnetic-toothed coupling 15, which is likewise shown with dash lines, to a drive (not shown). The carrier slide 13 is displaceable horizontally, in a not shown manner, in a machine frame 16**.

Figure 2:
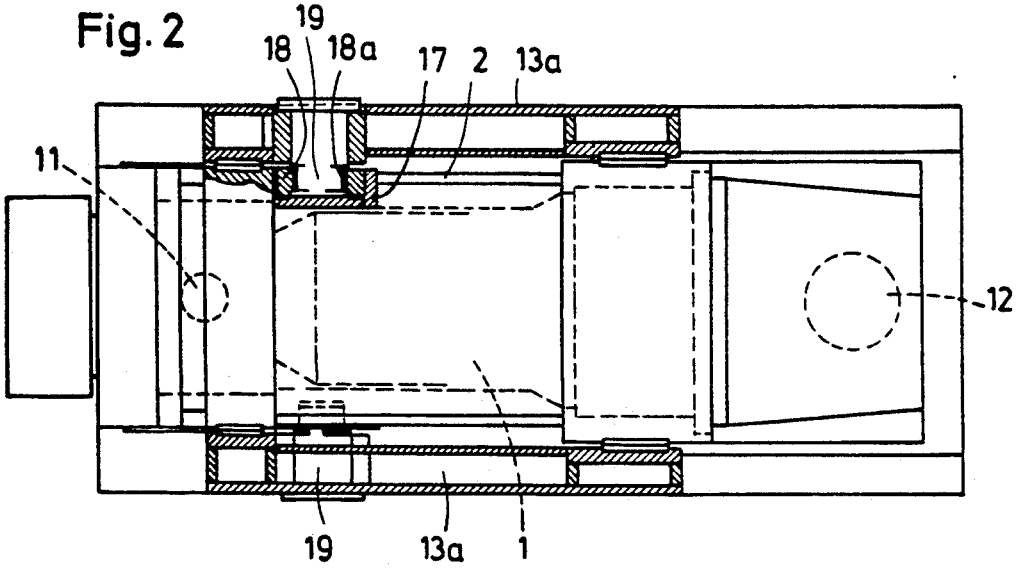
FIG. 2 shows an axial cross-sectional top view of the roller leveller in FIG. 1.

As can be seen in FIG. 2, with reference to FIG. 1, that the bearing housing 2 is provided, on opposite sides, with vertical guides 17 for bearing blocks 18. A bearing journal 19 engages in a bore 18*a* of the bearing block 18. As shown in FIG. 2, there are provided two bearing journals 19, which are secured in respective side walls 13*a* of the carrier slide 13. The common axis of the two bearing journals 19 defines the inclination adjustment axis of the bearing housing 2. The vertical guides 17 support the bearing housing 2 for pivotal movement about the inclination axis defined by the common axis of the bearing journals 19.

Figure 3:
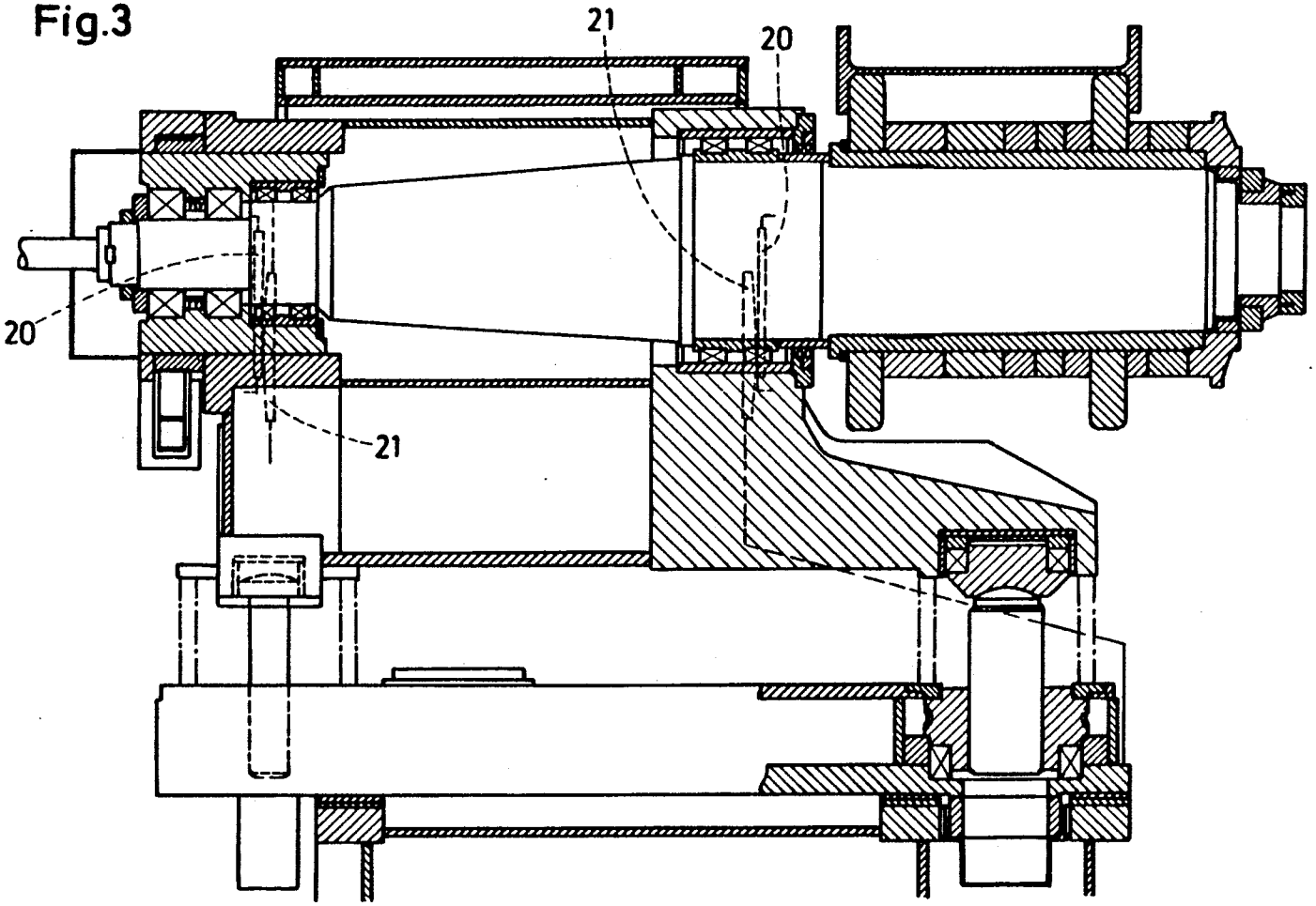
FIG. 3 shows a view similar to that of FIG. 1 of another embodiement of a roller leveller according to the present invention.
Figure 4:
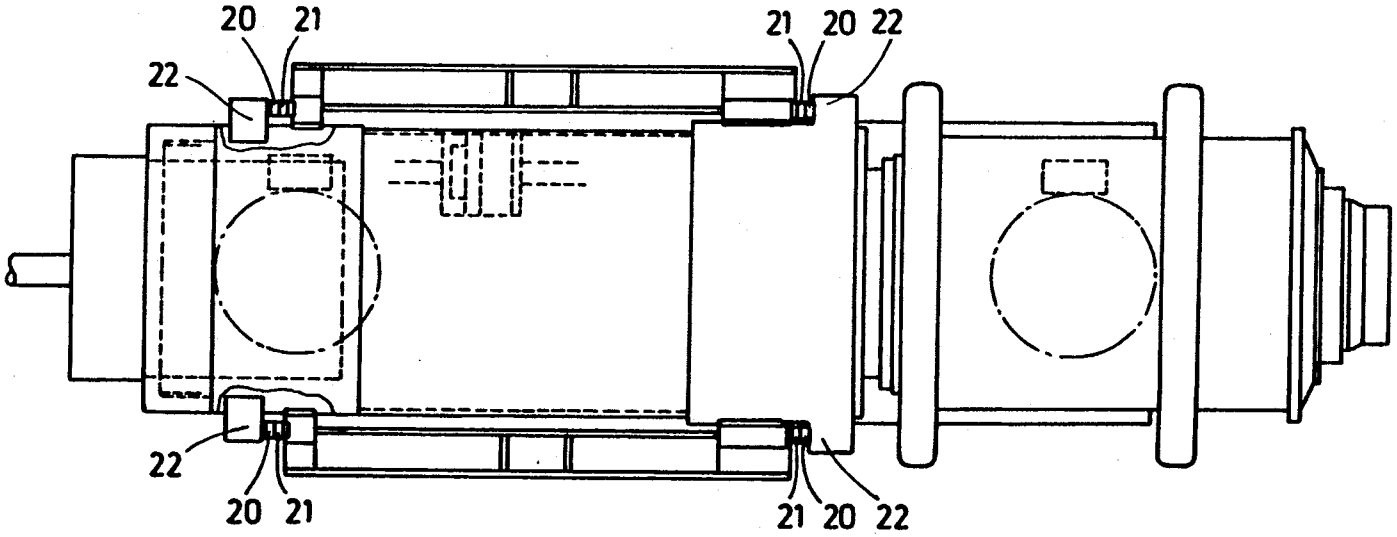
FIG. 4 shows a top view of the roller leveller of FIG. 3.
Figure 5:
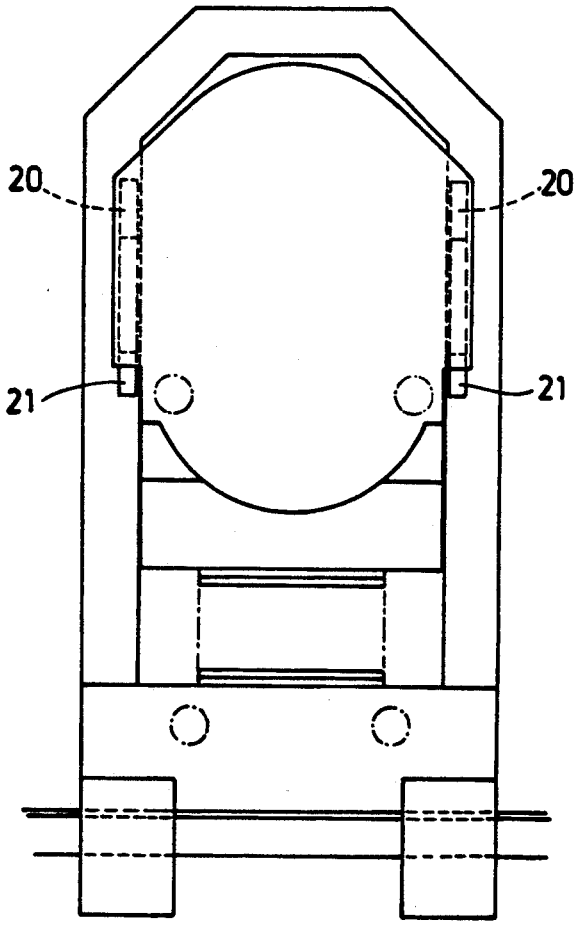
FIG. 5 shows a side view of the roller leveller in FIG. 3.

In the embodiment of FIGS. 3, 4 and 5, pairs of guide beads 20, which extend parallel to each other and transverse to the horizontal axial plane of the carrier shaft 1, are arranged on sidewise projecting stop shoulders 22. The guide beads 20 are supported on associated slightly convex supporting surfaces of corresponding strips 21, which are arranged on the slide 13 and project sidewise therefrom.

As it has been explained previously, the carrier shaft 1 can be displaced to a reproduced provisional adjusting position in FIG. 1 by simultaneously driving the lifting spindles 11 and 12. Then it can be brought into a definite, inclined to a horizontal, adjusting position by opening and closing, as the case may be, of the electromagnetic-toothed coupling 15 to displace only the spindle 11 to effect pivoting of the bearing housing 2 about the adjustment inclination axis, and actuating anew both spindles 11 and 12 together, as well as by an axial correction with the adjusting device 9, 10. All command, which are important for implementing the above-described adjustment, are provided by a control device on the basis of empirical values, with the control device being connected to a microprocessor in which preset position values are stored.

While the present invention has been shown and described with reference to the preferred embodiment, various modification will be apparent to those skilled in the art and, therefore, it is not intended that the invention be limited to the disclosed embodiment and/or details thereof, and departures can be made therefrom within the spirit and scope of the present invention as defined in the appended claims.

What is claimed is:

1. A roller leveller for beams having a large web depth, comprising:

an upper levelling roller means and a lower levelling roller means;

a carrier shaft for supporting said lower levelling roller means, wherein said carrier shaft has a longitudinal axis, and further wherein said lower levelling roller means are supported on said carrier shaft in a cantilever fashion;

a bearing housing for supporting said carrier shaft;

first and second spaced lifting elements for vertically displacing said bearing housing;

two vertical guides in which said bearing housing is vertically displaceable in opposite direction;

a horizontally displaceable carrier slide for supporting said two vertical guides; and means for pivoting said bearing housing about an inclination adjustment axis extending tranverse to the longitudinal axis of said carrier shaft.

2. The roller leveller of claim 1, wherein said pivoting means provides for pivoting of said two vertical guides.

3. The roller leveller of claim 1, wherein said two vertical guides each comprise a bearing block;

wherein said roller leveller comprises two opposite bearing journals, which are secured in said carrier slide and which support said bearing blocks, and further wherein a common axis of said bearing blocks defines the inclination adjustment axis.

4. The roller leveller of claim 3, wherein each bearing block has a bore for receiving a respective bearing journal.

5. The roller leveller of claim 1, wherein said two vertical guides comprise two parallel spaced guide beads extending transverse to the horizontal axial plane, and further wherein said roller leveller comprises guide strips, which are arranged on said carrier slide and having slightly convex support surfaces, respectively, for supporting associated guide beads.

6. The roller leveller of claim 1, wherein said first lifting element is arranged in a region below the lower levelling roller means, wherein said roller leveller further comprises two bearings for supporting said carrier shaft, wherein one of said two bearings is located adjacent to said lower levelling roller means and wherein the other of said two bearings is located remote from said lower levelling roller means, wherein said second lifting element is arranged in a region below another of said two bearings, and further wherein said pivoting means comprises a common shaft for commonly driving said first and second vertical elements and a magnetic coupling for releasably connecting said first vertical guide means to said common shaft.

7. The roller leveller of claim 1, further comprising adjusting means for axially displacing said carrier shaft.

* * * * *